US007444702B2

(12) United States Patent
Fogg

(10) Patent No.: US 7,444,702 B2
(45) **Date of Patent: *Nov. 4, 2008**

(54) PILLOW TOP FOR A CUSHION

(75) Inventor: David C. Fogg, Lexington, KY (US)

(73) Assignee: Tempur-Pedic Management, Inc., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/643,050

(22) Filed: Dec. 21, 2006

(65) Prior Publication Data

US 2007/0094803 A1 May 3, 2007

Related U.S. Application Data

(63) Continuation of application No. 10/685,298, filed on Oct. 14, 2003, now Pat. No. 7,155,765.

(51) Int. Cl.
*A47C 17/00* (2006.01)

(52) U.S. Cl. ..... 5/691; 5/740

(58) Field of Classification Search ..... 5/691, 5/727, 728, 738, 740, 903
See application file for complete search history.

(56) References Cited

U.S. PATENT DOCUMENTS

| | | | | |
|---|---|---|---|---|
| 1,457,203 | A * | 5/1923 | Wick | 5/722 |
| 1,592,146 | A * | 7/1926 | Miller et al. | 5/722 |
| 1,914,661 | A * | 6/1933 | Burke | 5/722 |
| 2,013,481 | A | 9/1935 | Stonehill | |
| 2,552,476 | A | 6/1951 | Barton | |
| 3,012,926 | A | 12/1961 | Wintermute et al. | |
| 3,080,578 | A | 3/1963 | Novascone | |
| 3,138,807 | A | 6/1964 | Blecker | |
| 3,619,366 | A | 11/1971 | Hughes | |
| 3,837,021 | A | 9/1974 | Sellers et al. | |
| 3,906,137 | A | 9/1975 | Ecchuya | |
| 3,974,532 | A | 8/1976 | Ecchuya | |
| 4,040,881 | A | 8/1977 | Wallace | |
| 4,042,986 | A | 8/1977 | Goodman et al. | |
| 4,197,342 | A | 4/1980 | Bethe | |
| 4,384,541 | A | 5/1983 | Schneider | |
| 4,449,261 | A | 5/1984 | Magnusson | |
| 4,606,088 | A | 8/1986 | Michaelsen et al. | |
| RE32,420 | E | 5/1987 | Autrey et al. | |
| 4,698,864 | A | 10/1987 | Graebe | |

(Continued)

FOREIGN PATENT DOCUMENTS

| | | |
|---|---|---|
| DE | 2457481 | 1/1976 |

(Continued)

*Primary Examiner*—Michael Trettel
(74) *Attorney, Agent, or Firm*—Michael Best & Friedrich LLP

(57) ABSTRACT

A support cushion has an elastic core having a first surface, a second surface and a thickness defined by the first surface and the second surface. A first cover portion substantially entirely encloses the elastic core. A pillow top surface is positioned adjacent the first surface of the elastic core. The pillow top surface includes a plurality of foam portions. A second cover portion at least partially covers the pillow top surface and the second cover portion attached to at least one of the first cover portion and the elastic core.

20 Claims, 2 Drawing Sheets

U.S. PATENT DOCUMENTS

| | | | | |
|---|---|---|---|---|
| 4,757,564 | A | 7/1988 | Goodale | |
| 4,769,267 | A | 9/1988 | Hoyt | |
| 4,782,540 | A | 11/1988 | Parker | |
| 4,788,972 | A | 12/1988 | DeBusk | |
| 4,824,171 | A | 4/1989 | Hollingsworth | |
| 4,840,430 | A | 6/1989 | Shimada | |
| 4,849,046 | A | 7/1989 | Kanazawa et al. | |
| 4,922,564 | A | 5/1990 | Thomas | |
| 4,955,095 | A | 9/1990 | Gerrick | |
| 4,961,238 | A | 10/1990 | Limb et al. | |
| 4,961,982 | A | 10/1990 | Taylor | |
| 4,962,554 | A | 10/1990 | Tesch | |
| 4,972,534 | A | 11/1990 | Hutton | |
| 5,003,654 | A | 4/1991 | Vrzalik | |
| 5,010,610 | A | 4/1991 | Ackley | |
| 5,081,728 | A * | 1/1992 | Skinner | 5/727 |
| 5,092,007 | A | 3/1992 | Hasty | |
| 5,102,711 | A | 4/1992 | Keller et al. | |
| 5,103,519 | A | 4/1992 | Hasty | |
| 5,117,519 | A * | 6/1992 | Thomas | 5/500 |
| 5,121,512 | A | 6/1992 | Kaufmann | |
| 5,172,436 | A | 12/1992 | Masuda | |
| 5,181,288 | A | 1/1993 | Heaton et al. | |
| 5,189,747 | A | 3/1993 | Mundy et al. | |
| 5,285,542 | A | 2/1994 | West et al. | |
| 5,294,181 | A | 3/1994 | Rose et al. | |
| 5,323,500 | A | 6/1994 | Roe et al. | |
| 5,355,816 | A | 10/1994 | Echevarria | |
| 5,369,828 | A | 12/1994 | Graebe | |
| D360,768 | S | 8/1995 | Hwang et al. | |
| 5,461,741 | A | 10/1995 | Graebe | |
| 5,475,881 | A | 12/1995 | Higgins et al. | |
| 5,513,402 | A | 5/1996 | Schwartz | |
| 5,523,144 | A | 6/1996 | Dyer, Jr. | |
| 5,551,107 | A | 9/1996 | Graebe | |
| 5,561,875 | A | 10/1996 | Graebe | |
| 5,572,757 | A | 11/1996 | O'Sullivan | |
| 5,592,706 | A | 1/1997 | Pearce | |
| 5,596,781 | A | 1/1997 | Graebe | |
| 5,611,096 | A | 3/1997 | Bartlett et al. | |
| 5,613,257 | A | 3/1997 | Graebe | |
| 5,634,225 | A | 6/1997 | Miller, Sr. et al. | |
| 5,655,241 | A | 8/1997 | Higgins et al. | |
| 5,669,094 | A | 9/1997 | Swanson | |
| 5,680,662 | A | 10/1997 | Purdy et al. | |
| 5,685,036 | A | 11/1997 | Kopfstein et al. | |
| 5,745,942 | A | 5/1998 | Wilkerson | |
| 5,782,190 | A | 7/1998 | Porter et al. | |
| 5,970,545 | A | 10/1999 | Garman et al. | |
| 5,974,994 | A | 11/1999 | Stutznacker et al. | |
| 5,987,668 | A | 11/1999 | Ackley | |
| 5,991,949 | A | 11/1999 | Miller, Sr. et al. | |
| 6,052,851 | A * | 4/2000 | Kohnle | 5/690 |
| 6,073,284 | A | 6/2000 | Borders | |
| D428,716 | S | 8/2000 | Larger | |
| 6,115,861 | A | 9/2000 | Reeder et al. | |
| 6,159,574 | A | 12/2000 | Landvik et al. | |
| 6,163,907 | A | 12/2000 | Larson | |
| 6,192,538 | B1 | 2/2001 | Fogel | |
| 6,223,369 | B1 | 5/2001 | Maier et al. | |
| 6,237,173 | B1 | 5/2001 | Schlichter et al. | |
| 6,256,821 | B1 | 7/2001 | Boyd | |
| 6,263,532 | B1 | 7/2001 | Miller | |
| 6,428,083 | B2 | 8/2002 | Dettoni et al. | |
| 6,481,033 | B2 | 11/2002 | Fogel | |
| 6,523,202 | B2 | 2/2003 | Loomos | |
| 6,588,038 | B1 | 7/2003 | Bondie et al. | |
| 6,658,683 | B2 | 12/2003 | Parvin | |
| 6,687,935 | B2 | 2/2004 | Reeder et al. | |
| 6,694,555 | B2 | 2/2004 | Soltani et al. | |
| 6,701,558 | B2 | 3/2004 | VanSteenburg | |
| 6,708,352 | B2 | 3/2004 | Salvatini et al. | |
| 6,715,173 | B2 * | 4/2004 | Barman et al. | 5/691 |
| 6,735,800 | B1 | 5/2004 | Salvatini et al. | |
| 6,745,419 | B1 * | 6/2004 | Delfs et al. | 5/691 |
| 6,785,923 | B2 | 9/2004 | Karafa et al. | |
| 6,787,078 | B2 | 9/2004 | English et al. | |
| 6,804,848 | B1 | 10/2004 | Rose | |
| 6,808,791 | B2 | 10/2004 | Curro et al. | |
| 6,813,790 | B2 | 11/2004 | Flick et al. | |
| 6,839,929 | B2 | 1/2005 | Stolpmann | |
| 6,848,138 | B1 | 2/2005 | Maier et al. | |
| 6,922,863 | B2 | 8/2005 | Giori et al. | |
| 6,952,852 | B2 | 10/2005 | Reeder et al. | |
| 7,007,330 | B2 | 3/2006 | Kuiper et al. | |
| 7,076,822 | B2 | 7/2006 | Pearce | |
| 7,155,765 | B2 * | 1/2007 | Fogg | 5/691 |
| 7,200,884 | B2 | 4/2007 | Wright et al. | |
| 2001/0013147 | A1 | 8/2001 | Fogel | |
| 2002/0015817 | A1 | 2/2002 | Lieblein | |
| 2002/0112287 | A1 | 8/2002 | Thomas et al. | |
| 2003/0056703 | A1 | 3/2003 | Blake | |
| 2003/0150060 | A1 | 8/2003 | Huang | |
| 2003/0186044 | A1 | 10/2003 | Sauniere et al. | |
| 2003/0192123 | A1 | 10/2003 | Chaffee | |
| 2004/0010855 | A1 | 1/2004 | Piraino | |
| 2004/0031103 | A1 | 2/2004 | Wyatt et al. | |
| 2004/0074008 | A1 | 4/2004 | Martens et al. | |
| 2004/0139552 | A1 | 7/2004 | Walters, Jr. | |
| 2004/0142619 | A1 | 7/2004 | Ueno et al. | |
| 2004/0237205 | A1 | 12/2004 | Perfosistem | |
| 2005/0000026 | A1 | 1/2005 | Gladney | |
| 2005/0097675 | A1 | 5/2005 | Borders et al. | |
| 2005/0210595 | A1 | 9/2005 | Di Stasio et al. | |
| 2006/0101580 | A1 | 5/2006 | Biggie et al. | |
| 2006/0260059 | A1 | 11/2006 | Apperson et al. | |
| 2006/0260060 | A1 | 11/2006 | Apperson et al. | |

FOREIGN PATENT DOCUMENTS

| | | |
|---|---|---|
| DE | 3321720 | 12/1984 |
| DE | 3803448 C | 8/1988 |
| EP | 0486016 | 5/1992 |
| EP | 0611538 | 8/1994 |
| EP | 0777988 | 6/1997 |
| EP | 0782830 | 7/1997 |
| EP | 0962171 | 12/1999 |
| EP | 1240852 | 9/2002 |
| FR | 837297 | 2/1939 |
| GB | 448275 | 6/1936 |
| GB | 949596 | 2/1964 |
| GB | 1545806 A | 5/1979 |
| GB | 2290256 | 12/1995 |
| GB | 2294635 | 5/1996 |
| GB | 2297057 | 7/1996 |
| GB | 2314506 | 1/1998 |
| JP | 2000005015 | 1/2000 |
| WO | 9908571 | 2/1999 |
| WO | 9915126 | 4/1999 |
| WO | 9943240 | 9/1999 |
| WO | 02062891 | 8/2002 |

* cited by examiner

PILLOW TOP FOR A CUSHION

CROSS-REFERENCE TO RELATED APPLICATIONS

This is a continuation of U.S. patent application Ser. No. 10/685,298 filed on Oct. 14, 2003 now U.S. Pat No. 7,155,765, the entire contents of which are incorporated herein by reference.

FIELD OF THE INVENTION

This invention relates generally to cushions, and more particularly to cushions including bed mattresses, seat cushions, backrest cushions, or any other cushion for supporting a body in part or its entirety.

BACKGROUND OF THE INVENTION

A typical cushion uses elastic foam material for suitably distributing pressure from the body over a relatively large surface area of the body being supported by the cushion, such as a person lying on a mattress, a person seated in a couch, or an animal resting on a veterinary surgeon's table.

When used in combination with some type of less elastic overlying layer, the elastic foam underlying layer in the cushion counteracts the deepest depressed parts in the overlying layer in order to provide an increased counter-pressure against the body. To achieve a reasonably limited cushion thickness, the underlying layer is typically arranged in the form of a highly-elastic foam layer or a spring base with mechanical springs to provide suitable support to the user.

Some conventional cushions have a "pillow top" surface or layer on top of or in place of the less elastic-overlying layer. In the mattress industry, conventional pillow top layers have been formed by inserting soft resilient filling materials into an enclosure that is interconnected with a top surface of a mattress core. Normally, when an innerspring coil mattress core is employed, the pillow top construction serves to essentially cushion the innerspring coils and to allow for more independent and unrestrained articulation resulting in improved conformability and interface pressure, thus improving overall comfort levels for a user of the mattress.

SUMMARY OF THE INVENTION

Some embodiments of the invention relate to a support cushion including an elastic core having a first surface, a second surface, a thickness defined by the first surface and the second surface, and a pillow top surface having a plurality of foam strips adjacent the first surface of the elastic core.

Other embodiments relate to a pillow top layer for a support cushion including an elastic core having a length and a width. The pillow top layer includes a plurality of foam strips having a length, a width, and a thickness. The width of each foam strip is substantially the same as the width of the elastic core and greater than the length of each foam strip. The plurality of foam strips are positioned side-by-side such that the combined length of the plurality of strips is substantially the same as the length of the elastic core.

Yet other embodiments relate to a support cushion having an elastic core and a pillow top portion adjacent to the core. The pillow top portion includes a plurality of foam strips positioned side-by-side and separated by a material different than the foam strips to form a non-continuous layer adjacent to the core.

BRIEF DESCRIPTION OF THE DRAWINGS

In the drawings, wherein like reference numerals indicate like parts.

Figure 1:
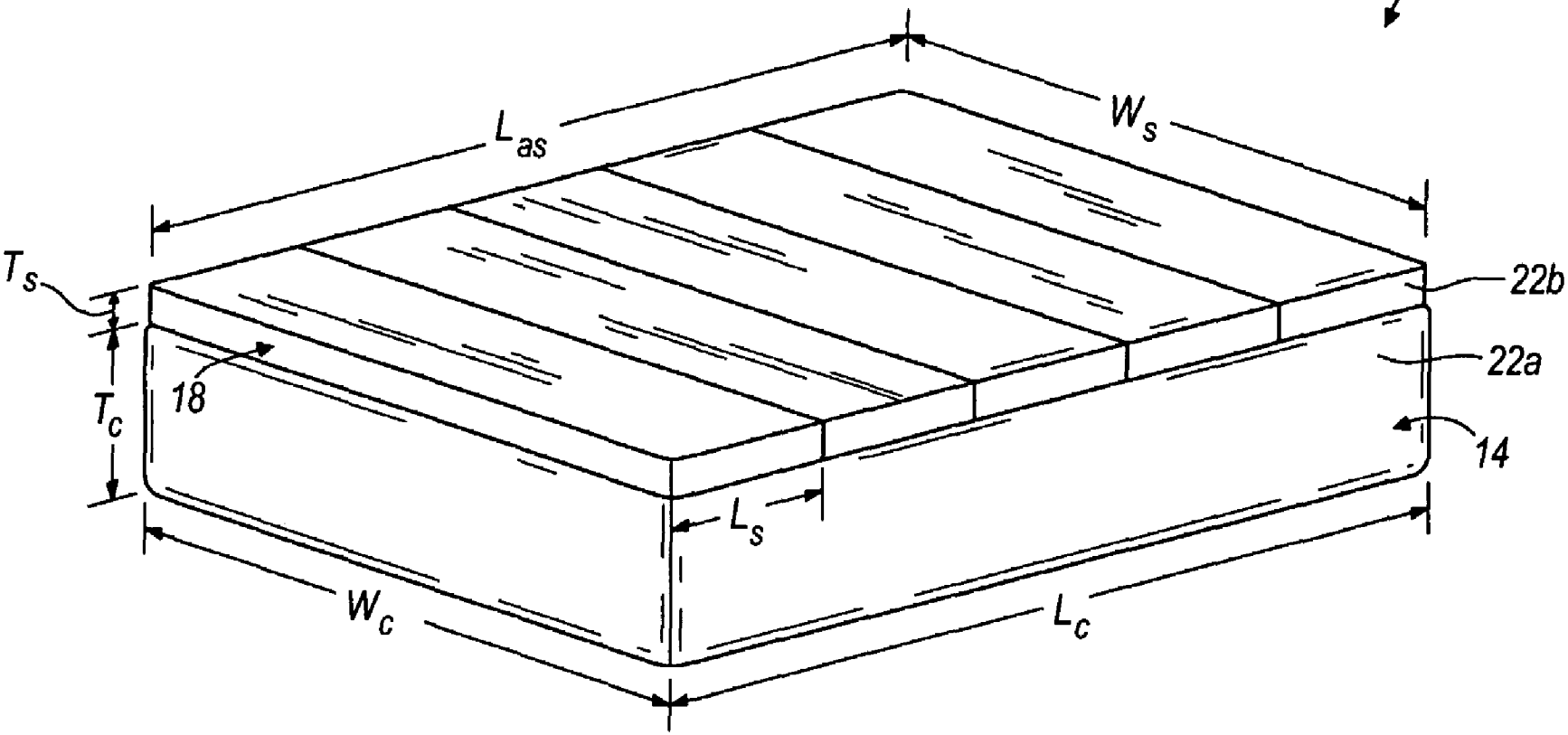
FIG. 1 illustrates a perspective view of a cushion embodying aspects of the present invention.
Figure 2:
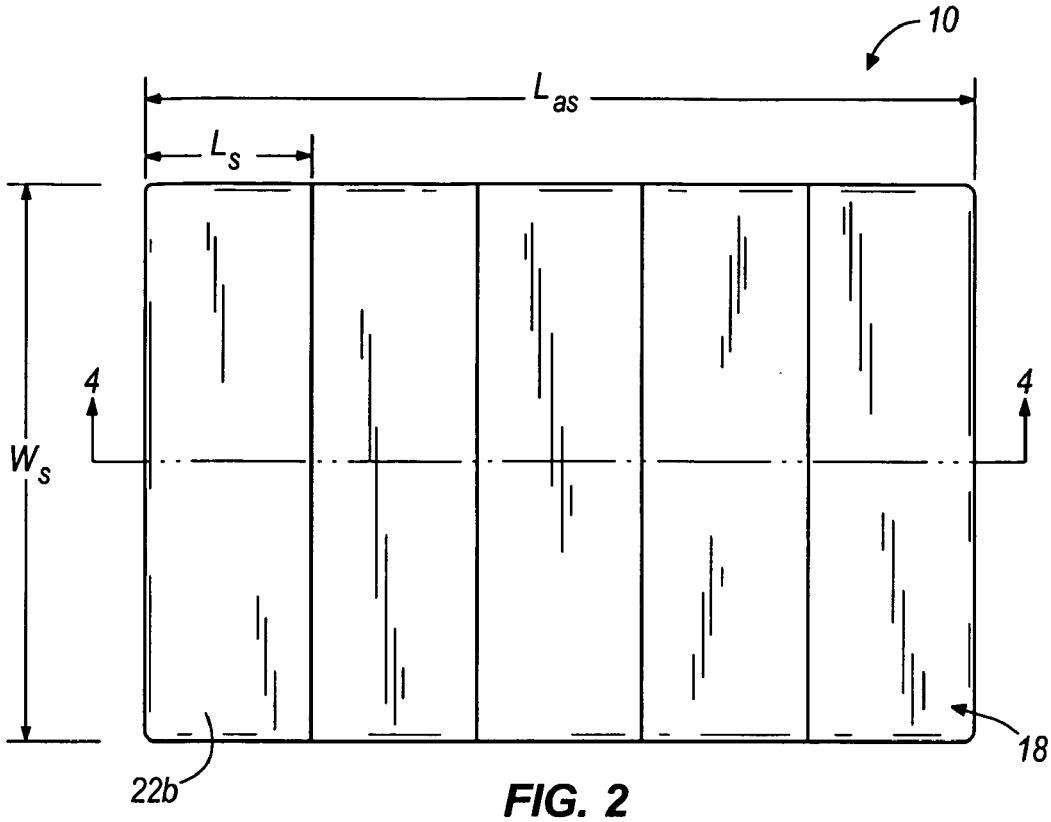
FIG. 2 is a top view of the cushion illustrated in FIG. 1.
Figure 3:
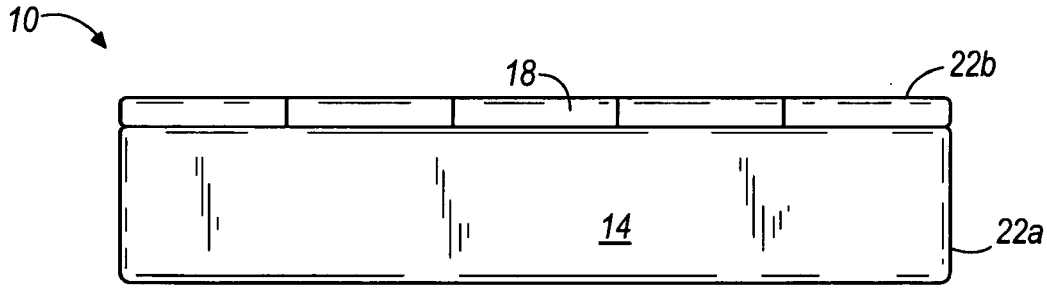
FIG. 3 is a side view of the cushion illustrated in FIG. 1.

Before the embodiments of the invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as a limitation of the present invention.

DETAILED DESCRIPTION

FIG. 1 illustrates one embodiment of the present invention. This cushion 10 has an elastic core 14 and a pillow top layer or portion 18. A cover 22 (or one or more portions thereof) surrounds the elastic core 14 and the pillow top portion 18. In some embodiments the elastic core 14 and the pillow top portion 18 are each surrounded by individual covers that are coupled together, while in other embodiments, the two portions 14, 18 are surrounded by a single cover.

The elastic core 14 of some embodiments can have any conventional construction or a construction similar to the cushions disclosed in the following related patents and applications: U.S. patent application Ser. No. 10/379,889 filed Mar. 5, 2003, U.S. Pat. No. 6,602,579, and U.S. Pat. No. 6,159,574, which are all commonly assigned and herein incorporated by reference. For example, the elastic core of some embodiments can have a plurality of springs covered with padding or foam. Other exemplary embodiments of the elastic core 14 can have one or more layers of foam, such as viscoelastic foam, polyurethane foam, HR foam, or other foams commonly used in the industry. For the sake of convenience, the cushioning material of the elastic core will be referred to as foam through out the detailed description. Thus, although the term foam will be used, it is to be understood that other conventional padding can also be used.

Figure 4:
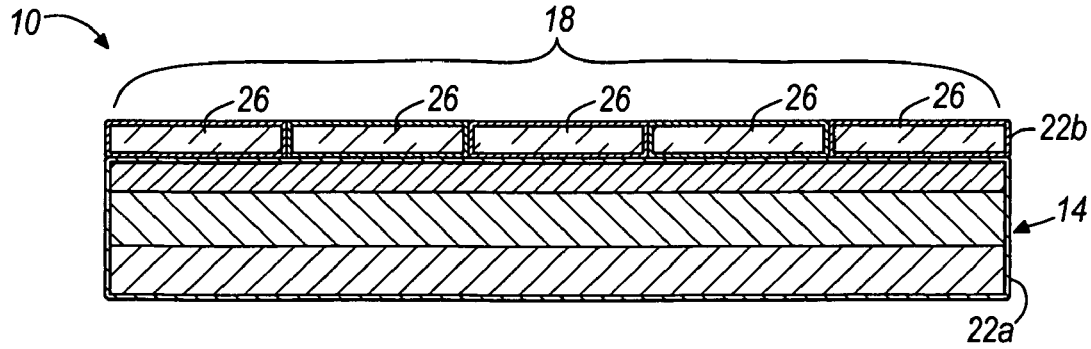
FIG. 4 is a cross-section of the cushion illustrated in FIG. 2 taken along line 4-4 of FIG. 2.

FIG. 4 shows a cross-section of the elastic core 14 having three layers of foam: a bottom, middle, and top layer as illustrated. Although any number of layers can be used and many different types of material can be used in each layer, the particular embodiment of the elastic core illustrated in FIG. 4 will be discussed. The bottom layer of the illustrated elastic core consists of highly elastic polyurethane foam. Preferably this layer has a density of twenty to seventy kilograms per cubic meter and a hardness of between one-hundred and ten to one-hundred and sixty Newtons at 40% Indention Force Deflection (IFD). The illustrated bottom layer has a density of about thirty-five kilograms per cubic meter and a hardness of about one hundred and forty Newtons at 40% IFD. The bottom layer can also have thickness between about five to fifteen centimeters. However, in the illustrated construction, the thickness of the bottom layer is about eleven centimeters. The surfaces of this layer can be flat or convoluted (e.g. truncated cones extending toward the next layer above).

The bottom layer is positioned adjacent to the middle layer. In some embodiments, these layers are attached to each other.

In this particular embodiment, the middle layer is identical to the bottom surface. However, in other embodiments, these two surfaces can be different (i.e., have different thicknesses, materials, densities, and hardnesses). The two layers can be fastened together by any conventional fastening technique such as fusing, gluing, or any other suitable mutual mechanical or chemical bonding.

The top layer of foam within the core has a thickness between about five centimeters and nine centimeters, but more preferably about seven centimeters. The top layer is placed adjacent the middle layer. Preferably, the top layer is fastened to the middle layer by fusing or gluing together or any other suitable mutual mechanical or chemical bonding between the layers. The top layer is made of a viscoelastic foam material with suitable density and hardness, such as the material marketed under the name TEMPUR®. In some embodiments, this layer has a density between fifty-five and one hundred and ten kilograms per cubic meter. Preferably, this layer has a density of eighty-five kilograms per cubic meter. This layer can also have a hardness between about fifty and eighty Newtons. Preferably, the hardness is sixty Newtons at 40% IFD.

The terms "top layer," "middle layer," and "bottom layer" are meant to describe the position of the individual layers in relation to each other based upon the illustration. Thus, the terms are not to be construed as the bottom layer being a layer always lying beneath the top layer relative to an upward and downward orientation. Rather, it is meant as a layer lying on the farthest side of the cushion in relation to the body of the user. Similarly, the top layer is a layer lying on the nearest side of the cushion in relation to the body of the user. If the cushion, for example, is mounted on a back rest, then the underlying layer, the overlying layer and the top layer, if provided, will be orientated sideways and not downwards and upwards, respectively.

Also, the term body should not be construed as only the whole body of the user. The body may be any part of the body such as a head if the cushion is used as a pillow, the buttocks if the cushion is used as a seat, or the back if the cushion is used as a backrest. However, the cushion may also support the whole body if the cushion is used as a mattress.

The elastic core has a length $L_c$, a width $W_c$, and a thickness $T_c$. In some embodiments the length $L_c$ is greater that the width $W_c$. For example, most mattresses have a length that is greater than the width. However, this does not preclude the width $W_c$ from being the same as or greater than the length $L_c$. The elastic core 14 can have a variety of thicknesses $T_c$ depending upon the materials comprising the elastic core 14, the number of layers within the elastic core 14, the feel desired, and the like.

As mentioned above and illustrated in FIGS. 1-4, the foam of the elastic core is contained within a cover. Specifically, the cover 22*a* illustrated in these figures only covers the foam elastic core 14 to protect the foam or other cushion materials of the elastic core. The cover 22*a* generally has about the same dimensions as the foam elastic core. Depending upon the characteristics desired from the cushion 10, the cover 22*a* can be made slightly larger or smaller than the size of the foam elastic core. For example, in some embodiments the cover is designed to fit snuggly over the foam elastic core to provide a firm feel. In other embodiments, the cover is not as snug to provide a softer feel. The cover 22*a* of some embodiments is made of fabric material. The cover can be at least partially elastic to allow a body on the cushion 10 to sink in. The cover can be secured to the foam elastic core 14 in a conventional manner. For example, the cover 22*a* can have a zipper (not illustrated) located along a peripheral edge or along one or more sides to allow the cover 22*a* to be removed, washed, and/or replaced.

The pillow top portion 18 of the illustrated cushion 10 comprises a plurality of foam strips 26 contained within individual covers 22*b* or sleeves. The foam strips 26 each have a length $L_s$, a width $W_s$, and a thickness $T_s$ which for the sake of convenience run in the same direction as the length $L_c$, width $W_c$, and thickness $T_c$ of the elastic core 14, respectively. The total width $W_s$ of the layer of foam strips 26 and the combined length $L_{as}$ of all of the individual foam strips is about equal to the width $W_c$ and length $L_c$ of the elastic core 14, respectively. In some embodiments, however, the width $W_s$ and combined length $L_{as}$ of the foam strips 26 can be slightly longer or slightly shorter than the respective measurement of the elastic core 14. For example, it is not uncommon for a pillow top surface to extend slightly over the edge of the elastic core 14. Thus, in such a situation, the width $W_s$ and length $L_{as}$ of the foam strips 26 may be slightly larger than the respective measurement on the elastic core 14. In some embodiments, the widths of each strip may be less than the width of the core. In such embodiments, two or more strips may be used so that the total width of the pillow top layer is about equal to the total width of the core.

The illustrated embodiment has five equal-length foam strips each having a length $L_s$ that is less than its width. This arrangement places the seam between each strip in an orientation that runs from one side of the cushion to the other. Although the strips could run in the other direction (top to bottom), the illustrated direction is the preferred orientation for a mattress. This allows the pillow top surface to be separated into zones of different softness and cushioning. These zones can be sized to correspond with typical locations of certain features of the human body. For example, a different zone may be used for lower legs, upper legs, hips, lower back, middle back, upper back, head, and neck. Also, by running the seam perpendicular to the direction in which a person would normally lay on the mattress, there is less likelihood that a person will lie within a seam. However, the seam can run along the length of the cushion 10 in some embodiments.

Although the illustrated embodiment only shows five strips 26, other embodiments can have more or less strips. For example, some embodiments can have as few as three strips, while other embodiments can have as many as twenty strips. Preferably, the pillow top layer 18 has between four and eight strips.

Although the strips 26 are illustrated as having equal lengths $L_s$, the length $L_s$ of each foam strip 26 does not have to be the same. Rather the length can vary depending upon the location of the strip 26 on the cushion. For example, if the cushion is a mattress, the strips can have different lengths corresponding to the desired size of each zone on the mattress. For example, an average person's hips will generally fall within a predetermined area on the mattress and need to sink into the mattress more than the small of the back to properly align the spine. Thus, a zone having a select length and softness can be positioned in this area. The adjacent zones can have different widths and/or densities to properly align the back and legs with the hips.

The feel of the pillow top surface can be specifically engineered based on among other things the types of material used, the density and hardness of the material used, as well as the thickness of the material used. The strips 26 can have a thicknesses $T_s$ greater than about one centimeter. However, preferably the strips 26 have a thicknesses $T_s$ that is less than about ten centimeters. Generally, the cushion feels softer and plusher with a thicker layer of foam. However, beyond a certain thickness, the layer can become too cushioned and a person may not have sufficient support or may feel trapped in the foam. Therefore, in some embodiments the thickness $T_s$ is between two centimeters and seven centimeters. However, in other embodiments the thickness is between four and six centimeters.

The foam strips 26 can be made of substantially any material. However, in some preferred embodiments, the foam strips are made of viscoelastic foam. As mentioned above, viscoelastic foam can also be used in the elastic core 14. Viscoelastic foam assumes the form—in a somewhat "reluctant" manner—of the shape of the body being supported by the visco-elastic foam. After assuming the form of the body, the viscoelastic foam returns in a correspondingly "reluctant" manner to its original form when the pressure from the body is removed. A general definition of a visco-elastic foam may be ascertained from the following scenario: A rigid object, such as a steel ball, is dropped vertically downwards from a height of 1 m onto a plane surface of the visco-elastic foam resulting in an upward rebound of the rigid object of less than 10%, i.e., a rebound of less than 10 cm upwards from the plane surface of the viscoelastic foam.

The viscoelastic foam thus exercises only a modest elastic counter-pressure against that surface by which it is loaded, and for precisely this reason it will therefore allow the body to sink relatively deeply into the cushion in such a manner to distribute its overall counter-pressure over a large area of the body, with a relatively uniform and relatively low counter-pressure per unit area of the supported area of the body.

When utilized in cushions, the viscoelastic foam is intended especially to alleviate or counteract sores such as bedsores (decubitus) obtained from high-pressure points when lying on a mattress for long periods of time. Such high-pressure points may be generated by the highly elastic foam layer or the spring base with mechanical springs supporting the weight of the body. Thus, it is desirable to limit the poor pressure distribution of the highly elastic foam utilized in a typical cushion.

The way the pillow top layer feels is not only determined based upon thickness, but it is also dependent upon the density and hardness of the foam. In some embodiments, the density of the foam strips 26 can be greater than fifty-five kilograms per cubic meter. In other embodiments, the density can be less than one hundred and ten kilograms per cubic meter. Preferably, the density is between seventy and one hundred kilograms per cubic meter. More preferably, the density is between eighty and ninety kilograms per cubic meter. Most preferably, the density is about 85 kilograms per cubic meter. In some embodiments, the density is not the same in each strip 26.

The hardness of the foam strips 26 can be greater than twenty-five Newtons in some embodiments. In other embodiments, the foam strip 26 can have a hardness of less than sixty-five Newtons. Preferably, the hardness is between thirty Newtons and sixty Newtons. More preferably, the strips 26 have a hardness between forty Newtons and fifty-five Newtons. Most preferably, the strips have a hardness of about fifty Newtons. The hardness of each strip does not have to be constant. Rather, the strips can have a varying hardness to provide different zones of comfort. Preferably, the hardness is measured at 40% IFD.

As illustrated in FIG. 4 each strip 26 is contained within a sleeve of cover 22*b*. The sleeve separates each adjacent strip from each other and provides a pillow top look. The sleeves can totally contain each side of each foam strip 26 (including the top and bottom) or the sleeves can be designed to surround only a portion of each strip 26. For example, the sleeves can surround four sides and the top of each strip without covering the bottom. Furthermore, adjacent sleeves can be connected to each other in some embodiments. As such, a common seam or edge along the length of the cushion can be established to connect the cover 22*b* to the cover 22*a* of the elastic core 14. However, in some embodiments, each strip 26 and cover 22*b* around the strip can be attached individually to the core 14 or to the cover 22*a* on the core 14. The pillow top cover 22*b* can be attached to cover 22*a* using any suitable fastener such as a zipper, adhesive, straps, or even sewing pillow top cover 22*b* to the cover 22*a*. A zipper or other removable fastener may be preferable in some situations where one may want to remove the cover to wash it or replace it.

In yet other embodiments, the covers 22*a* and 22*b* can be combined into a single cover 22 (removable or not). For example, the entire cushion 10 (core and strips) can be surrounded with a cover material and the top surface of the cover can be sewn to the core along the seam of each of the pillow top strips. In such a situation, the strips 26 can be placed contiguous with the core 14. More specifically, the strips 26 can be fastened directly to the core 14. In other embodiments, the strips 26 of foam can also be enclosed within sleeves of the cover 22 and then the cover 22 can be placed onto the foam elastic core 14. In yet other embodiments, the cover can be formed with channels of material. The foam strips 26 could be placed into the channels and then the foam elastic core can be positioned within the cover.

In some embodiments, it may be desirable to place a material having a low coefficient of friction such as a polypropylene anti-shear material between the foam strips and/or the elastic core to allow for some sliding movement of the strips 26 relative to each other. In addition, cover 22, 22*b* can be somewhat elastic so that the user can sink into cushion and allow the cushion 10 to conform to the user's shape, thereby relieving interface pressure.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, some embodiments of the invention have been described with reference to specific types of foam, such as highly elastic foam and visco-elastic foam, as well as specific dimensions, densities, and hardnesses. However, the type foam, the dimensions of the foams and the combinations of the foams may be different, without departing from the scope of protection. Variations and modifications of the foregoing embodiments are within the scope of the present invention. It is understood that the invention disclosed and defined herein extends to all alternative combinations of two or more of the individual features mentioned or evident from the text and/or drawings. For example, various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments. All of these different combinations constitute various alternative aspects of the present invention.

Various features of the invention are set forth in the following claims.

I claim:

1. A pillow top layer for a support cushion, the pillow top layer comprising:

a first elongated foam portion having a first side opposite a second side, and upper and lower faces extending between and connecting the first and second sides;

a second elongated foam portion having a third side opposite a fourth side, and upper and lower faces extending between and connecting the third and fourth sides, the first and second foam portions being positioned together in a generally parallel arrangement such that one of the first side and second side is generally parallel and adjacent to one of the third side and fourth side, the upper faces of both first and second elongated foam portions collectively defining a substantially planar top surface of the pillow top layer; and a cover that substantially covers the first elongated foam portion and the second elongated foam portion wherein the cover substantially separates the first and second elongates foam portions, wherein the cover, the first elongated foam portion and the second elongated foam portion define a generally contiguous and substantially gapless structure, and wherein the pillow top layer is positioned adjacent an elastic core having length and width dimensions, and wherein the first elongated foam portion and the second elongated foam portion substantially cover the width dimension of the elastic core.

2. The pillow top layer of claim 1, wherein at least a portion of the cover generally separates the first and second elongated foam portions from the elastic core.

3. The pillow top layer of claim 1, wherein the elastic core has a greater hardness than the first and second foam portions.

4. The pillow top layer of claim 1, wherein the first and second elongated foam portions comprise viscoelastic foam.

5. The pillow top layer of claim 1, where the first and second elongated foam portions have a thickness of between two and seven centimeters.

6. A pillow top layer for a support cushion having an elastic core having a length and a width wherein the length is greater than the width, the pillow top layer comprising:

a plurality of foam portions, each of the plurality of foam portions having a length, a width, and a thickness, the width of each foam portion is substantially the same as the width of the elastic core and greater than the length of each foam portion, wherein adjacent portions having substantially planar facing sides positioned side-by-side to define a substantially gapless structure, wherein the combined length of the plurality of portions is substantially the same as the length of the elastic core; and a cover extending between adjacent foam portion of the pillow top layer that generally covers the elastic core and the foam portions.

7. The pillow top layer of claim 6, wherein the cover defines at least one sleeve that substantially covers at least one of the plurality of foam portions.

8. The pillow top layer of claim 6, wherein at least a portion of the sleeve generally separates the first and second elongated foam portions from the elastic core.

9. The pillow top layer of claim 6, wherein the elastic core has a greater hardness than the plurality of foam portions.

10. The pillow top layer of claim 6, wherein the plurality of foam portions comprise viscoelastic foam.

11. The pillow top layer of claim 6, where the plurality of foam portions each have a thickness of between two and seven centimeters.

12. The pillow top layer of claim 6, wherein the plurality of foam portions substantially cover the elastic core.

13. A support cushion comprising:

an elastic core having a first surface, a second surface and a thickness defined between the first surface and the second surface;

a first cover portion substantially entirely enclosing the elastic core;

a pillow top surface adjacent the first surface of the elastic core, the pillow top surface including a plurality of foam portions; and a second cover portion at least partially covering the pillow top surface, the second cover portion attached to at least one of the first cover portion and the elastic core.

14. The support cushion of claim 13, wherein the second cover portion is releasably attached to the first cover portion.

15. The support cushion of claim 13, wherein the foam portions are positioned side-by-side to substantially cover the first surface of the elastic core.

16. The support cushion of claim 13, wherein at least one of the first and second cover portions separates the foam portions from the elastic core.

17. The support cushion of claim 13, wherein the second cover portion includes at least one sleeve that at least partially houses at least one of the foam portions.

18. The support cushion of claim 13, wherein the foam portions comprise viscoelastic foam.

19. The support cushion of claim 13, wherein the foam portions each have a thickness of between two and seven centimeters.

20. The support cushion of claim 13, wherein the elastic core has a greater hardness than the foam portions.

* * * * *